US006488247B1

(12) United States Patent
Gonzalez

(10) Patent No.: US 6,488,247 B1
(45) Date of Patent: Dec. 3, 2002

(54) SUPPORTING SYSTEM FOR AIR CONDITIONING REGISTER BOXES

(76) Inventor: Isidro Gonzalez, 8005 NW. 162 St., Miami Lakes, FL (US) 33016

( * ) Notice: Subject to any disclaimer, the term of this patent is extended or adjusted under 35 U.S.C. 154(b) by 0 days.

(21) Appl. No.: 09/900,837

(22) Filed: Jul. 6, 2001

(51) Int. Cl.[7] ..... F16M 11/00
(52) U.S. Cl. ..... 248/201; 248/225.21; 248/220.1
(58) Field of Search ..... 248/672, 674, 248/201, 225.21, 220.1; 403/401, 402, 403, 406

(56) References Cited

U.S. PATENT DOCUMENTS

| | | | | | |
|---|---|---|---|---|---|
| 528,679 | A | * | 11/1894 | McGahey | 217/69 |
| 2,804,952 | A | * | 9/1957 | Nothdurft | 403/293 |
| 3,782,054 | A | * | 1/1974 | Goss, Jr. | 40/782 |
| 3,824,639 | A | * | 7/1974 | Mandusky | 403/205 |
| 4,024,691 | A | * | 5/1977 | Hansen et al. | 403/402 |
| 4,205,470 | A | * | 6/1980 | Kapnek | 40/782 |
| 4,283,900 | A | * | 8/1981 | Schubert | 403/402 |
| 4,592,187 | A | * | 6/1986 | Crites et al. | 29/464 |
| 4,815,364 | A | * | 3/1989 | Wagner et al. | 98/114 |
| 6,249,671 | B1 | * | 6/2001 | Tucker et al. | 455/90 |
| 6,315,495 | B1 | * | 11/2001 | Starheim | 220/4.33 |

* cited by examiner

*Primary Examiner*—Anita King
*Assistant Examiner*—A. Joseph Wujciak, III
(74) *Attorney, Agent, or Firm*—J. Sanchelima; A. Bordas

(57) ABSTRACT

A supporting system for air conditioning duct housings or register boxes including a housing member with perpendicular walls defining corners and a flat surface on the bottom and a connecting casing defining an aperture with one or more corner clips that are removably mounted from the outer surface of the walls. The corner clip includes a plate with two arms that are receivable within a longitudinally extending fixed structural member, such as a rail, provided with a longitudinal channel that has a longitudinal trough and opening. Resilient raised tabs provided in the arms keep the latter locked within the channel. Rigid tab members extend perpendicularly from the inner edges of the arm members and are lockingly receivable within the housing member through cooperating slots. A vertex portion between the arm members provides support to the corners.

3 Claims, 2 Drawing Sheets

SUPPORTING SYSTEM FOR AIR CONDITIONING REGISTER BOXES

BACKGROUND OF THE INVENTION

1. Field of the Invention

The present invention relates to a supporting system for air conditioning register boxes, and more particularly, to a system that can be readily mounted to the outside of the box.

2. Description of the Related Art

Many designs for supporting members have been designed in the past for air conditioning register boxes. None of them, however, permit a user to mount and/or unmount a box from outside the latter and without having to disassemble it or reach the supporting system from inside the duct housing or register box.

Applicant believes that the closest reference corresponds to a product being marketed by Sherer Manufacturing Incorporated (SMI), 12475 North, 44th Street, Clearwater, Fla. 33762, under model Nos. RAB, RB and RBB. See saler literature attached. However, it differs from the present invention because inherent in the design is the lack of flexibility in using or not using the supporting member. Pre-mounted members may or may not be used. Thus, the need to over-design the device to anticipate all possibilities for support. Also, because of the characteristics of the design it cannot mount a duct housing to a fixed structure.

SUMMARY OF THE INVENTION

It is one of the main objects of the present invention to provide a supporting system that can be readily mounted externally to a duct housing or register box without disassembling it or requiring from inside the box.

It is another object of this invention to provide a supporting assembly that ensures structural integrity by selectively distributing the boxes' weight as needed.

It is still another object of the invention to provide a system that can be adapted to different fixed supporting structures.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
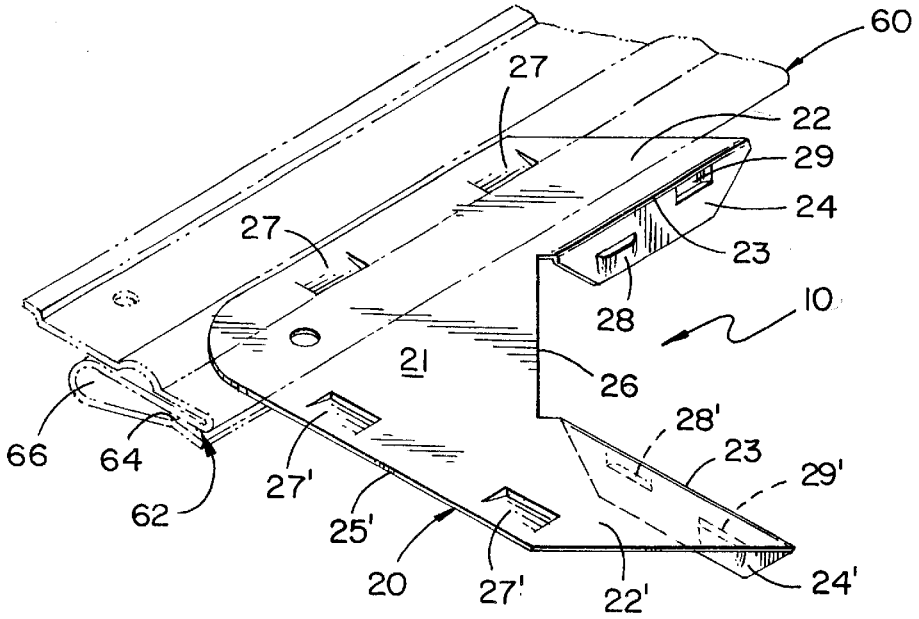
FIG. 1 represents an isometric view of one of the preferred embodiments for the supporting system object of the present invention mounted to a rail (shown in phantom).
Figure 1A:
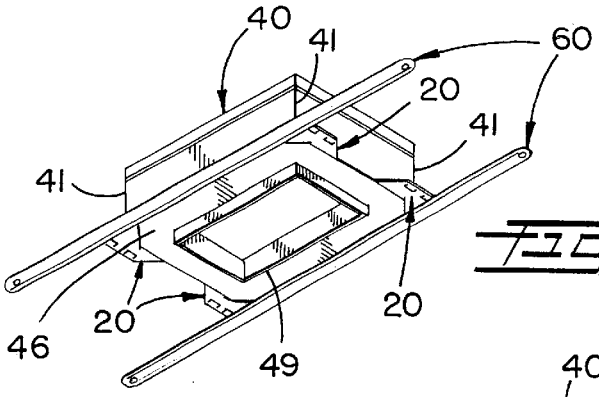
FIG. 1*a* is an isometric view of a register box mounted to two parallel extending rail members.

Referring now to the drawings, where the present invention is generally referred to with numeral 10, it can be observed that it basically includes corner clip 20 and register housing or box 40 mounted to fixed rail 60. Clip 20 is mounted from outside box 40 and it is not required to have access to its internal space.

Housing 40 has a substantially rectangular shape with four wall corners 41. Each corner 41 includes two perpendicularly mounted walls 42 and 44. Housing or box 40 also includes flat surface 46 defining the bottom with casing 49. Casing 49 is designed to provide a connection surface for other duct components. Wall 42 includes slot 43 starting near corner 41 and disposed in a parallel and spaced apart relationship with respect to top border 47. Also, wall 44 includes slot 45 near corner 41 and disposed in a parallel and spaced apart relationship with respect to top border 48. Slots 43 and 45 are formed by punching out a portion of walls 42 and 44, respectively.

Figure 2:
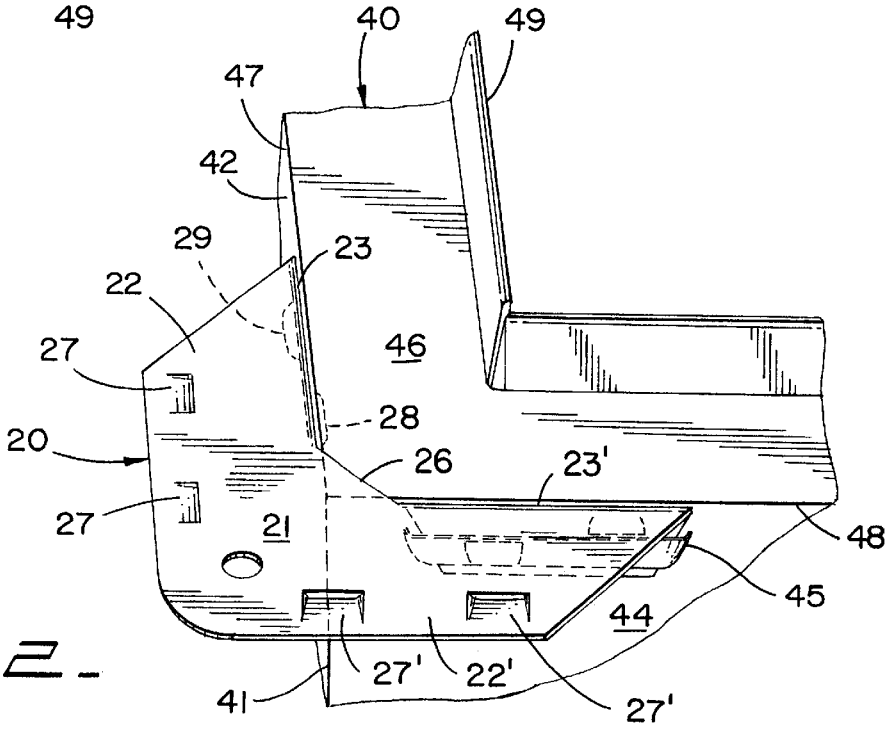
FIG. 2 shows an isometric view of the embodiment represented in FIG. 1 mounted to a register box (partially represented) as seen from the bottom.

As seen in FIG. 1, corner clip 20 includes a flat plate 21 with two arms 22 and 22' perpendicularly disposed with respect to each other. Comer clip 20 also includes a vertex portion 26 that joins arms 22 and 22'. Arm 22 has internal edge 23 and external edge 25 extending parallel with respect to each other. In the same manner, arm 22' has internal edge 23' and external edge 25' extending parallel with respect to each other. As seen in FIG. 2, vertex portion 26 co-acts with surface 46 to provide structural support when corner clip 20 is mounted to housing 40.

Figure 3:
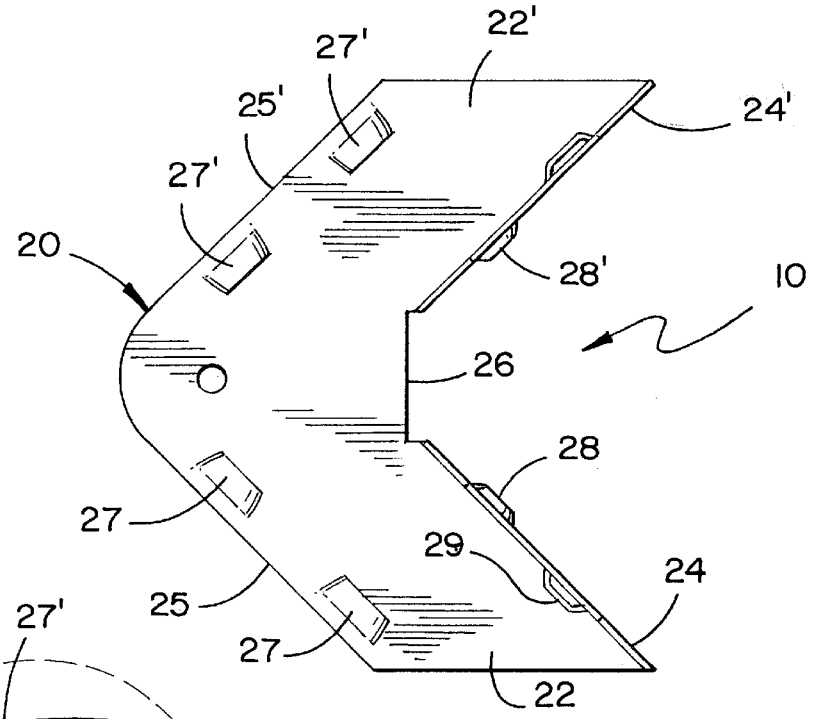
FIG. 3 illustrates a top view of a corner clip used in this embodiment as part of the support system.
Figure 4A:
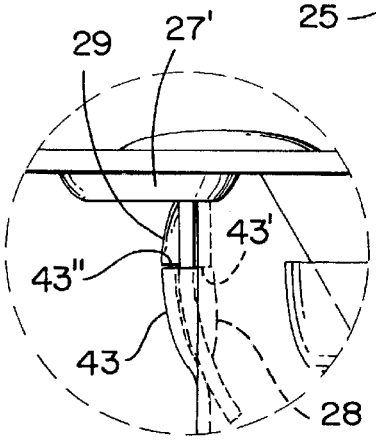
FIG. 4*a* is a detail-enlarged view of the locking arrangement of punched slots with the slot of the housing.

Corner clip 20 has rigid tab members 24 and 24' perpendicularly mounted to internal edges 23 and 23' respectively, as best seen in FIG. 1. Tab members 24 and 24' are cooperative receivable within slots 43 and 45 respectively. Tab members 24 (and 24') include punched slots 28 and 29 (28' and 29') that lock the former to slots 43 and 45, respectively. As it can be best seen in FIGS. 1 and 3, slot 28 (and 28') is punched outwardly whereas slot 29 (and 29') is punched inwardly. FIG. 4*a* shows the locking action of punched slot 28 with the lower wall 43' of housing slot 43 that prevents upwardly disengagement of clip 20 from housing 40. Punched slot 29 co-acts with upper wall 43" of housing slot 43 to prevent further downwardly travel of tab 24.

Figure 4:
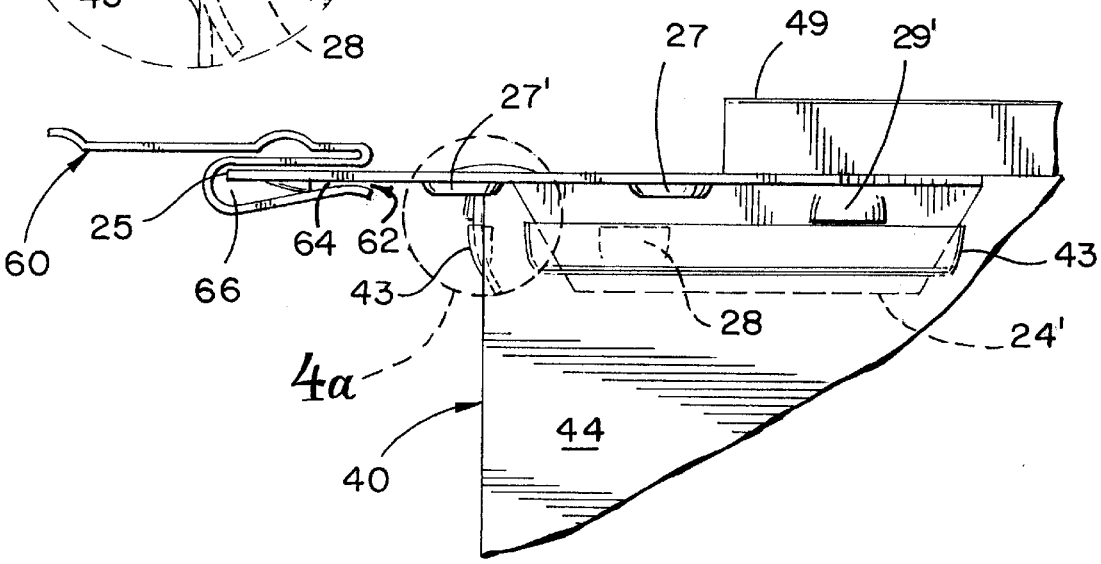
FIG. 4 is a front elevational view of the corner clip mounted to a register box (partially represented) and to a fixed rail (also partially represented).

Elongated mounting rail 60 has a longitudinally extending channel 62 which cooperatively receive external edges 25 or 25', and a portion of arms 22 or 22' providing structural support to housing 40. As best seen in FIG. 4, external edge 25 is received within trough 66 of channel 62. Arm 22 (and arm 22') is provided with raised tabs 27 (tabs 27' for arm 22') that are slightly deflected as they are passed through reduced longitudinal entrance 64 and brought back to its original raised position when inside trough 66 of channel 62. Entrance 64 is also resilient and deflects slightly to permit the passage of raised tabs 27 and 27'. In this manner, fixed rail 60, or other equivalent fixed structure, provides support for clip 20, which in turn is rigidly attached to register box 40.

The foregoing description conveys the best understanding of the objectives and advantages of the present invention.

Different embodiments may be made of the inventive concept of this invention. It is to be understood that all matter disclosed herein is to be interpreted merely as illustrative, and not in a limiting sense.

What is claimed is:

1. A supporting system for air conditioning register boxes comprising:

A) housing means having at least one wall corner defined by two perpendicularly mounted walls said corner including first and second ends and said walls including at least one housing slot on each of said walls, and further including a bottom with a flat surface joining said corner or corners at one of said ends;

B) a corner clip including a flat plate having first and second arm portions extending perpendicularly with respect to each other and a vertex portion joining said first and second arm portions, said first arm portion including first internal and external edges extending parallel with respect to each other and being separated a first predetermined distance, and said second arm portion including internal and external edges extending parallel with respect to each other and being separated a second predetermined distance and further including first and second rigid tab members perpendicularly mounted to said first and second internal edges, respectively, said first and second rigid tab members being receivable within said housing slots, and said vertex portion co-acting with said flat surface to provide structural support;

C) a fixed structural member including means for receiving and supporting said first and second external edges thereby providing support to said housing means.

2. The supporting system set forth in claim 1 wherein said means for receiving and supporting said first and second external edges includes a longitudinally extending channel having a longitudinal opening and a longitudinal trough with cooperative dimensions to receive said first and second external edges.

3. The supporting system set forth in claim 2 wherein said opening is resilient and wherein said first and second arm portions include each a plurality of resilient raised tabs that cammingly deflect themselves and/or said opening to permit the insertion of said edges within said trough upon the application of an inwardly directed force of a predetermined magnitude.

* * * * *